US007914652B2

(12) United States Patent
Yamada et al.

(10) Patent No.: US 7,914,652 B2
(45) Date of Patent: Mar. 29, 2011

(54) OXYGEN GAS DIFFUSION CATHODE FOR SODIUM CHLORIDE ELECTROLYSIS

(75) Inventors: Yuji Yamada, Fujisawa (JP); Yuki Izawa, Fujisawa (JP); Yoshinori Nishiki, Fujisawa (JP)

(73) Assignee: Permelec Electrode Ltd., Kanagawa (JP)

( * ) Notice: Subject to any disclaimer, the term of this patent is extended or adjusted under 35 U.S.C. 154(b) by 651 days.

(21) Appl. No.: 11/941,277

(22) Filed: Nov. 16, 2007

(65) Prior Publication Data

US 2008/0116063 A1 May 22, 2008

(30) Foreign Application Priority Data

Nov. 21, 2006 (JP) ..... 2006-314216

(51) Int. Cl.
*C25B 11/03* (2006.01)

(52) U.S. Cl. ..... 204/284; 204/283; 429/523; 429/525; 429/532; 429/534

(58) Field of Classification Search ..... 204/283, 204/284; 429/523, 525, 532, 533, 534
See application file for complete search history.

(56) References Cited

U.S. PATENT DOCUMENTS

| | | | | |
|---|---|---|---|---|
| 4,486,276 | A | 12/1984 | Cohn et al. | |
| 6,117,286 | A | 9/2000 | Shimamune et al. | |
| 7,708,867 | B2 * | 5/2010 | Yamada et al. | 204/283 |

FOREIGN PATENT DOCUMENTS

| | | | |
|---|---|---|---|
| CN | 1474883 | A | 2/2004 |
| CN | 1763252 | A | 4/2006 |
| EP | 1643014 | A2 | 4/2006 |
| JP | 11-124698 | A | 5/1999 |
| JP | 11-246986 | A | 9/1999 |
| JP | 2004-149867 | A | 5/2004 |
| JP | 3553775 | B2 | 5/2004 |
| JP | 2004-197130 | A | 7/2004 |
| JP | 2004-209468 | A | 7/2004 |
| JP | 2005-63713 | A | 3/2005 |
| WO | 01/93999 | A2 | 12/2001 |
| WO | 0238833 | A1 | 5/2002 |
| WO | 2004/027901 | A2 | 4/2004 |

OTHER PUBLICATIONS

"Domestic/overseas Situation Concerning Oxygen Cathodes for Sodium Chloride Electrolysis" (Soda & Chlorine, vol. 45, 85 (1994)).
Extended European Search Report dated Dec. 3, 2008.

* cited by examiner

*Primary Examiner* — Bruce F Bell
(74) *Attorney, Agent, or Firm* — Sughrue Mion, PLLC

(57) ABSTRACT

The present invention provides an oxygen gas diffusion cathode for sodium chloride electrolysis comprising: a porous conductive substrate comprising silver, a hydrophobic material and a carbon material; a catalyst comprising silver and palladium, coated on the porous conductive substrate.

3 Claims, 4 Drawing Sheets

OXYGEN GAS DIFFUSION CATHODE FOR SODIUM CHLORIDE ELECTROLYSIS

FIELD OF THE INVENTION

The present invention relates to an oxygen gas diffusion cathode for sodium chloride electrolysis having excellent durability at a low cell voltage, which is used for sodium chloride electrolysis.

BACKGROUND OF THE INVENTION

Use of Oxygen Gas Diffusion Cathode in Industrial Electrolysis

Use of an oxygen gas diffusion electrode in industrial electrolysis has recently come to be investigated. For example, a hydrophobic cathode for conducting an oxygen reduction reaction is used in an apparatus for the electrolytic production of hydrogen peroxide. Also, in processes for alkali production or acid/alkali recovery, a hydrogen oxidation reaction (hydrogen anode) as a substitute for oxygen generation on an anode or an oxygen reduction reaction (oxygen cathode) as a substitute for hydrogen generation on a cathode is conducted by using a gas diffusion electrode, thereby attaining a reduction in the electric power consumption. It has been reported that when a hydrogen anode is used as a counter electrode in metal recovery, for example, zinc collection or zinc plating, depolarization is possible.

Caustic soda (sodium hydroxide) and chlorine which are important as an industrial raw material are being produced mainly by a sodium chloride electrolysis method. This electrolysis method has shifted through a mercury method in which a mercury cathode is used and the diaphragm method in which an asbestos diaphragm and a soft-iron cathode are used to an ion exchange membrane method in which an ion exchange membrane is used as a diaphragm and an active cathode having a low overvoltage is used. During this interval, the electric power consumption rate required for the production of 1 ton of caustic soda has decreased to 2,000 kWh. However, since the caustic soda production is a large electric consumption industry, a further reduction in the electric power consumption rate is demanded.

In a related-art sodium chloride electrolysis method, an anode reaction and a cathode reaction are shown in the following schemes (1) and (2), respectively, and a theoretical decomposition voltage thereof is 2.19 V.

$$2Cl^{-}\text{--*}C12+2e(1.36\ V) \quad (1)$$

$$2H2O+2e\text{-}+20H^{-}H2(-0.83\ V) \quad (2)$$

When an oxygen cathode is used in place of conducting a hydrogen generation reaction on a cathode, a reaction shown in the following scheme (3) takes place. As a result, a cell voltage can be reduced theoretically by 1.23 V, or by about 0.8 V even in a practically useful current density range. Thus, a reduction in the electric power consumption rate of 700 kWh per ton of sodium hydroxide can be expected.

$$02+2H_20+4e\text{-}+40H^{-}(0.40\ V) \quad (3)$$

For that reason, practical implementation on a sodium chloride electrolysis method utilizing a gas diffusion cathode has been investigated since the 1980s. However, in order to realize this process, it is indispensable to develop an oxygen cathode which is required to have not only high performance but sufficient stability in the electrolysis system.

An oxygen gas cathode in the sodium chloride electrolysis is described in detail in "Domestic/overseas Situation Concerning Oxygen Cathodes for Sodium Chloride Electrolysis" in *Soda & Chlorine*, Vol. 45, 85 (1994).

Gas Diffusion Cathode for Sodium Chloride Electrolysis

An electrolytic cell of the sodium chloride electrolysis method using an oxygen cathode which is most generally conducted at present is of a type in which an oxygen cathode is disposed on a cathode side of a cation exchange membrane via a cathode chamber (caustic chamber) and oxygen as a raw material is supplied from a gas chamber disposed at the back of the cathode. This cell is configured of three chambers of an anode chamber, a catholyte chamber and a cathode gas chamber and hence, is called a three-chamber type electrolytic cell. The oxygen supplied to the gas chamber diffuses within the electrode and reacts with water in a catalyst layer to form sodium hydroxide. Accordingly, the cathode which is used in this electrolysis method must be a gas diffusion cathode of a so-called gas/liquid separation type through which only oxygen sufficiently permeates and in which a sodium hydroxide solution does not leak out to the gas chamber. A gas diffusion cathode in which a catalyst such as silver and platinum is supported on an electrode substrate obtained by mixing a carbon powder and PTFE and forming the mixture in a sheet form has been proposed as an electrode satisfying those requirements.

However, this type of electrolysis method involves some problems. The carbon powder used as an electrode material is readily deteriorated at high temperatures under the coexistence of sodium hydroxide and oxygen, thereby remarkably lowering the electrode performance. Also, it is difficult to prevent the leakage of the sodium hydroxide solution to the gas chamber side as generated with an increase of liquid pressure and deterioration of the electrode especially in a largesized electrolytic cell.

For the purpose of solving these problems, a novel electrolytic cell has been proposed. This electrolytic cell is characterized in that an oxygen cathode is disposed in intimate contact with an ion exchange membrane (zero gap structure) and that oxygen and water as raw materials are supplied from the back of the electrode, whereas sodium hydroxide as a product is recovered from the back of the electrode or a lower part of the electrode. When this electrolytic cell is used, the problem regarding the foregoing leakage of sodium hydroxide is solved, and the separation between a cathode chamber (caustic chamber) and a gas chamber is not necessary. Since this electrolytic cell is configured of two chambers of a single chamber functioning as both a gas chamber and a cathode chamber (caustic chamber) and an anode chamber, it is called a two-chamber type electrolytic cell.

The performance required for the oxygen cathode which is suitable for an electrolysis process using this electrolytic cell is largely different from that required for related-art oxygen cathodes. Since the sodium hydroxide solution which has leaked out to the back of the electrode is recovered, the electrode need not have a function to separate a caustic chamber from a gas chamber and is not required to have an integrated structure, and size enlargement is relatively easy.

Even when the gas diffusion cathode is used, the formed sodium hydroxide not only moves to the back side but moves in a height direction due to gravity. Accordingly, there is a problem that when the formed sodium hydroxide is in excess, the sodium hydroxide solution resides in the inside of the electrode, thereby inhibiting gas supply. The gas diffusion cathode is required to simultaneously have sufficient gas permeability, sufficient hydrophobicity for avoiding wetting due to a sodium hydroxide solution, and hydrophilicity for enabling a sodium hydroxide solution to readily permeate through the electrode. In order to meet these requirements, a method for disposing a hydrophilic layer between an ion exchange membrane and an electrode is proposed in Japanese Patent No. 3553775.

As an electrolytic cell which is positioned intermediate between these electrolytic cells, an electrolytic cell of a liquid dropping type in which a gas cathode having gas/liquid permeability is disposed slightly apart from a membrane and an alkaline solution is allowed to flow from an upper part thereof through a gap therebetween has also been developed (see U.S. Pat. No. 4,486,276).

Apart from improvements in electrolytic cells, extensive and intensive investigations regarding electrode catalysts and substrates are also being advanced.

JP-A-11-246986 discloses a gas diffusion cathode in which a reaction layer having at least a hydrophilic fine particle and a catalyst fine particle of silver in a mixed state and formed by hot pressing together with a fluorocarbon resin and a gas supply layer are superimposed.

JP-A-2004-149867 discloses a gas diffusion electrode in which a gas diffusion electrode forming fine particle is made of a fluorocarbon resin fine particle, a carbon black fine particle and one or two or more kinds of fine particles selected from a polymeric electrolyte fine particle, a metal colloid, a metal fine particle and a metal oxide fine particle.

JP-A-2004-197130 and JP-A-2004-209468 disclose a gas diffusion cathode for sodium chloride electrolysis using an electrode catalyst which is made of a conductive carrier and a mixture containing a noble metal fine particle and a fine particle of at least one alkaline earth metal or rare earth oxide supported on the conductive carrier.

JP-A-2005-063713 discloses an electrode catalyst which is made of a carbonaceous carrier, a fine particle of a noble metal such as platinum, palladium, iridium, ruthenium and alloys thereof supported on a surface of the carbonaceous carrier, and a surface layer for making the surface of the carbonaceous carrier electrochemically inactive.

JP-A-11-124698 discloses that it is desirable to form a catalyst layer on a surface of an electrode support; that a metal such as platinum, palladium, ruthenium, iridium, copper, cobalt, silver and lead or oxides thereof can be used as the catalyst; and that by mixing such a catalyst with a binder such as fluorocarbon resins as a powder and a solvent such as naphtha to form a paste and adhering it, or applying a salt solution of a catalyst metal on the surface of the support and baking it, or subjecting the salt solution to electroplating or electroless plating by using a reducing agent to form a reaction layer, this reaction layer and a gas supply layer are superimposed to form a gas diffusion electrode.

However, in comparison with fuel cells, since an industrial electrolysis system is severe with respect to operation conditions, it involves a problem that sufficient life and performance of a gas diffusion cathode are not obtained. In particular, there is a problem regarding an increase of overvoltage and a reduction of conductivity due to a reduction of catalytic performance. Concretely, though silver catalysts or carbon particles are mainly utilized at present from the viewpoints of performance and economy, it is known that in electrolysis and electrolysis termination operations, agglomeration or dropping of the particles advances, leading to a cause of the performance reduction. Even in the foregoing known technologies, this problem remains unsolved.

SUMMARY OF THE INVENTION

An object of the invention is to provide an excellent gas diffusion cathode which is stable over a long period of time and has a low cell voltage as compared with electrodes of the related art in the field of sodium chloride electrolysis.

Other objects and effects of the invention will become apparent from the following description.

The invention provides an oxygen gas diffusion cathode for sodium chloride electrolysis comprising: a porous conductive substrate comprising silver, a hydrophobic material and a carbon material; and a catalyst comprising silver and palladium, coated on the porous conductive substrate. It is preferable that the catalyst has a molar ratio of silver to palladium of from 10/1 to 1/4. Moreover, it is preferable that the carbon material is a carbon cloth or a carbon fiber sintered body.

Silver which is used as a porous conductive substrate or a catalyst is excellent in conductivity as compared with carbon materials, and its use as a conductive material is appropriate. However, as described previously, the silver has properties to cause agglomeration. On the other hand, palladium has catalytic activity and is excellent in stability. Accordingly, by (1) using a carbon material as a porous substrate, (2) using silver as a conductive raw material of the porous substrate, (3) using a hydrophobic material as a gas-permeable material of the porous substrate and (4) using a catalyst comprising silver and palladium having an appropriate composition and supporting such a catalyst on the porous substrate, it is possible to achieve a reduction of overvoltage, a reduction of resisting components and an enhancement of durability. The resulting electrode can be used as a cathode for sodium chloride electrolysis which is severe with respect to electrolysis conditions among industrial electrolytic reactions.

While the foregoing known patent documents disclose technologies mainly concerning a silver single body or carbon particles, these patent documents do not disclose a detailed catalyst composition as in the invention.

Besides, there are published patent documents, for example, JP-A-7-278864, JP-A-11-200080, JP-A-11-246986, JP-A-2000-239877 and JP-A-2002-206186. However, these patent documents do not mention improvements to which the invention pays attention.

Reasons why the foregoing problems are solved are as follows.

A catalyst layer 2 of a gas diffusion cathode 1 as illustrated in FIG. 1 contains a fine particle of a mixture of silver and palladium or an alloy thereof, and this catalyst layer 2 is coated and formed on a porous conductive substrate 3 comprising silver, a hydrophobic material and a carbon material. By the catalyst layer 2, a reduction of resistance and a reduction of overvoltage due to an enhancement of catalytic activity can be attained; and the conductive substrate 3 is configured to have excellent gas supply properties due to porosity and an enhancement of the conductivity and is able to attain a reduction of overvoltage, a reduction of resisting components and an enhancement of durability. Thus, the resulting electrode can be used as a cathode for sodium chloride electrolysis which is severe with respect to electrolysis conditions in among electrolytic reactions.

Among platinum-group metals, platinum and palladium are good in corrosion resistance and catalytic activity. Palladium is inexpensive as compared with platinum and brings an economical merit. Thus, palladium is used in the invention. The palladium can be suitably used as a catalyst of the gas diffusion cathode for sodium chloride electrolysis of the invention.

The invention is concerned with a gas diffusion cathode for oxygen reduction, in which silver/palladium catalyst particles are supported and formed on a porous conductive substrate comprising silver, carbon and a hydrophobic material, especially a hydrophobic resin. For the purpose of minimizing the use amount of the expensive palladium catalyst as far as possible, by mixing or alloying palladium with relatively inexpensive silver to highly disperse and impart silver having good conductivity to a porous carbon material, a low cell voltage can be stably exhibited over a long period of time.

Figure 1:
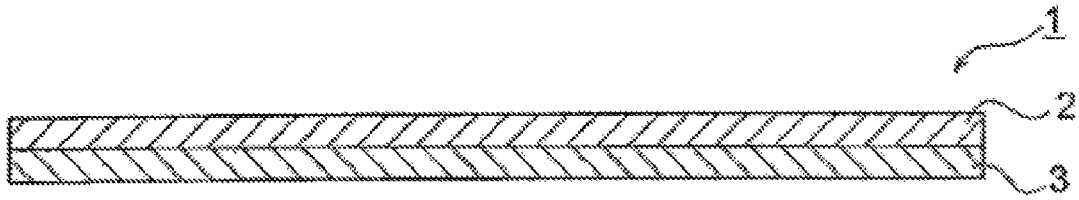
FIG. 1 is a diagrammatic cross-sectional view illustrating a gas diffusion cathode of the invention.

The reference numerals used in the drawings denote the followings, respectively.

1: Gas diffusion cathode
2: Catalyst layer
3: Conductive substrate
11: Electrolytic cell main body for sodium chloride electrolysis
12: Cation exchange membrane
13: Anode chamber
14: Cathode chamber
15: Insoluble metal anode
24: Flow-down chamber

DETAILED DESCRIPTION OF THE INVENTION

Configurative members of the gas diffusion cathode for oxygen reduction according to the invention are hereunder described in more detail.

Porous Conductive Substrate

A porous material such as a cloth and a fiber sintered body each made of carbon is used as an electrode substrate. It is preferable that the substrate has moderate porosity for the supply and removal of a gas and a liquid and further has sufficient conductivity. The substrate preferably has a thickness of from 0.05 to 5 mm, a porosity of from 30 to 95% and a typical pore size of from 0.001 to 1 mm. The carbon cloth is a woven fabric from bundles of several hundreds thin carbon fibers of several μm. This is a material having excellent gas/liquid permeability and can be favorably used. Carbon paper is a material obtained by forming raw carbon fibers into a precursor of a thin membrane by a paper making method and sintering this precursor. This is also a material suitable for use. The foregoing substrate materials generally have a hydrophobic surface and are a preferred material from the viewpoint of supplying an oxygen gas. However, these substrate materials are an unsuitable material from the standpoint of discharging the formed sodium hydroxide. Also, since the hydrophobicity of these substrate materials changes with the progress of operation, it is known to use a hydrophobic resin (material) as described later for the purpose of keeping a sufficient gas supply ability over a long period of time. However, when the hydrophobicity is too high, the removal of the formed sodium hydroxide solution becomes slow, whereby the performance rather reduces.

Next, in order to impart moderate hydrophilicity, a silver powder is mixed with a hydrophobic resin, water and a solvent such as naphtha to form a paste, which is then applied and adhered on the substrate. Thus, the supply and removal ability of a gas and a liquid is enhanced to impart sufficient conductivity, whereby an increase of voltage due to resistivity can be reduced.

As the hydrophobic material, fluorinated pitch, fluorinated graphite, fluorocarbon resins, and the like are preferable. In particular, in order to obtain a uniform and good performance, it is a preferred method to bake a fluorocarbon resin with durability at a temperature of from 200° C. to 400° C. and use it. What the application, drying and baking are divided several times and conducted is especially preferable because a uniform layer is obtained. The hydrophobic material, in particular the hydrophobic resin not only imparts sufficient gas permeability but prevents wetting due to the sodium hydroxide solution.

Besides, a material obtained by forming a carbon powder and a fluorocarbon resin into a plate-like form while using a metal material such as a silver mesh as a core material is also useful as the conductive porous substrate.

Catalyst Particle

The kind of the catalyst which is used in the gas diffusion cathode for oxygen reduction of the invention is of a mixture or alloy catalyst comprising silver and palladium.

As such a catalyst, commercially available particles may be used, and catalysts obtained by synthesis according to a known method may be used. For example, it is preferred to employ a wet method of synthesis by mixing an aqueous solution of silver nitrate and palladium nitrate with a reducing agent. A silver particle may be used and charged in a palladium salt aqueous solution, followed by a reduction reaction to form palladium on the silver particle. A synthesis method by heat decomposition upon addition of an organic material in a raw salt solution is also suitable.

The particle size of the catalyst particle is preferably from 0.001 to 1 pm. The amount of the catalyst is preferably from 10 to 500 g/m$^2$ from the viewpoints of electrolytic performance and economy. A molar ratio of silver to palladium is suitably from 10/1 to 1/4. When the amount of silver is too large, a reduction of overvoltage cannot be expected. On the other hand, when the amount of silver is too small, the conductivity in the catalyst layer is reduced, and an effect to be brought by mixing cannot be revealed.

These catalyst components can also be formed directly on a substrate as described later by a heat decomposition method, a dry method such as vapor deposition and sputtering, or a wet method such as plating.

Cathode Formation Method

The foregoing catalyst powder is mixed with a hydrophobic resin, water and a solvent such as naphtha to form a paste, which is then applied and adhered on the substrate. As the hydrophobic resin material, a fluorocarbon resin is preferable, and the particle size of the powder of the fluorocarbon component is preferably from 0.005 to 10 μm. In order to obtain a uniform and good performance, it is a preferred method to bake a fluorocarbon resin with durability at a temperature of from 200° C. to 400° C. and use it. What the application, drying and baking are divided several times and conducted is especially preferable because a uniform catalyst layer is obtained. The hydrophobic resin not only imparts sufficient gas permeability but prevents wetting due to the sodium hydroxide solution.

It is possible to form the silver/palladium catalyst by using silver nitrate as a silver raw material and palladium nitrate, dinitrodiamine palladium or the like as a palladium raw material, dissolving these materials in a reducing organic solvent such as methanol and allyl alcohol, applying the solution on the porous substrate and then conducting heat decomposition.

Since the foregoing conductive substrate of the invention contains silver, it is possible to firmly form by coating the silver-containing catalyst layer of the invention on the substrate.

Since the resulting electrode is used by applying a pressure in a thickness direction, it is not preferable that the conductivity in the thickness direction is changed by this. For the purpose of stabilizing the performance, it is preferable that the electrode is subjected to press processing in advance. According to the press processing, by compressing a carbon material, not only its conductivity is heightened, but the change in conductivity which occurs when the electrode is used upon applying a pressure is stabilized. Thus, the degree of bonding between the catalyst and the substrate is enhanced, thereby contributing to an enhancement of conductivity. Also, the compression of the substrate and the catalyst layer and the enhancement of the degree of bonding between the catalyst and the substrate enhance an ability to supply an oxygen gas as a raw material. As a press processing apparatus, known apparatus such as a hot press and a hot roller can be used. With respect to the pressing condition, it is desirable that the pressing is conducted at a temperature of from room temperature to 360° C. under a pressure of from 1 to 50 kgf/cm$^2$.

Thus, a gas diffusion cathode having high conductivity and catalyst properties is manufactured.

Hydrophilic Layer

As described previously, in the case where a two chamber type gas diffusion cathode is applied to a largesized sodium chloride electrolytic cell having a high current density, disposition of a hydrophilic layer between a diaphragm (ion exchange membrane) and an electrode (cathode) is effective in holding an electrolyte and removing the electrolyte from a reaction field.

The hydrophilic layer is preferably of a porous structure comprising a metal or resin having corrosion resistance. Since the hydrophilic layer is a member which does not contribute to the electrode reaction, it need not have conductivity. Preferred examples thereof include carbon, ceramics such as zirconium oxide and silicon carbide, resins such as hydrophilized PTFE and FEP, and metals (for example, silver). With respect to the shape, the hydrophilic layer is preferably a sheet having a thickness of from 0.01 to 5 mm. Since the hydrophilic layer is disposed between the diaphragm and the cathode, it is preferably made of a material which has resiliency and which, when an uneven distribution of pressure is generated, deforms and buffers the unevenness. The hydrophilic layer is preferably made of such a material and has such a structure that the layer always retains a catholyte. If desired, a hydrophilic material may be formed on the surface.

Examples of the structure include a net, a woven fabric, a non-woven fabric, and a foam. A powder is used as the raw material and formed into a sheet-like form together with a pore forming agent and a binder of every kind, and the pore forming agent is then removed with a solvent to form a sintered plate. A porous structure prepared by superimposing such sintered plates may also be used. A typical pore size thereof is from 0.005 to 5 mm.

Conductive Support

In disposing the gas diffusion cathode in an electrolytic cell, a conductive support material can be used for the purposes of supporting the cathode and assisting the electrical continuity. It is preferable that the support material has appropriate uniformity and cushioning properties. Known materials such as metal meshes made of nickel, stainless steel or the like, springs, leaf springs, and webs may be used. In the case where a material other than silver is used, it is preferable from the viewpoint of corrosion resistance that the support material is subjected to silver plating.

As a method for disposing the foregoing cathode in the electrolytic cell, it is preferable that a diaphragm, a gas/liquid permeation layer (hydrophilic layer), a gas cathode and a support are integrated under a pressure of from 0.05 to 30 kgf/cm$^2$. The gas/liquid permeation layer and the gas cathode interposed between the cathode support and the diaphragm are fixed by resiliency of the support and a difference of water pressure due to a liquid height of the anolyte. These members may be integrated in advance before fabrication of the cell and then interposed between cell gaskets or secured in the support in the same manner as for the diaphragm.

Electrolysis Method

In the case of using the electrode of the invention in sodium chloride electrolysis, a fluorocarbon resin based membrane is optimal as the ion exchange membrane from the standpoint of corrosion resistance. It is preferable that the anode is a titanium-made insoluble electrode called DSE or DSA and that the anode is porous such that it can be used in intimate contact with the ion exchange membrane.

In the case where it is necessary that the cathode of the invention is brought into intimate contact with the ion exchange membrane, it may suffice to mechanically bond the both in advance or apply a pressure at the electrolysis. The pressure is preferably from 0.05 to 30 kgf/cm$^2$. With respect to the electrolysis condition, the temperature is preferably from 60° C. to 95° C., and the current density is preferably from 10 to 100 A/dm$^2$. The oxygen gas is humidified as the need arises. With respect to the humidification method, it can be freely controlled by providing a humidifying device heated to 70 to 95° C. at a cell inlet and passing the oxygen gas therethrough. In the case of the performance of currently commercially available membranes, when a concentration of anode water is kept at 200 g/L or less and 150 g/L or more, it is not necessary to conduct the humidification. On the other hand, among newly developed membranes, those in which humidification is not necessary also exist. Though a concentration of sodium hydroxide is suitably from 25 to 40%, it is basically determined depending upon characteristics of the membrane.

Next, the sodium chloride electrolytic cell in which the oxygen gas diffusion cathode for sodium chloride electrolysis of the invention is used is described with reference to illustrated examples.

Figure 2:
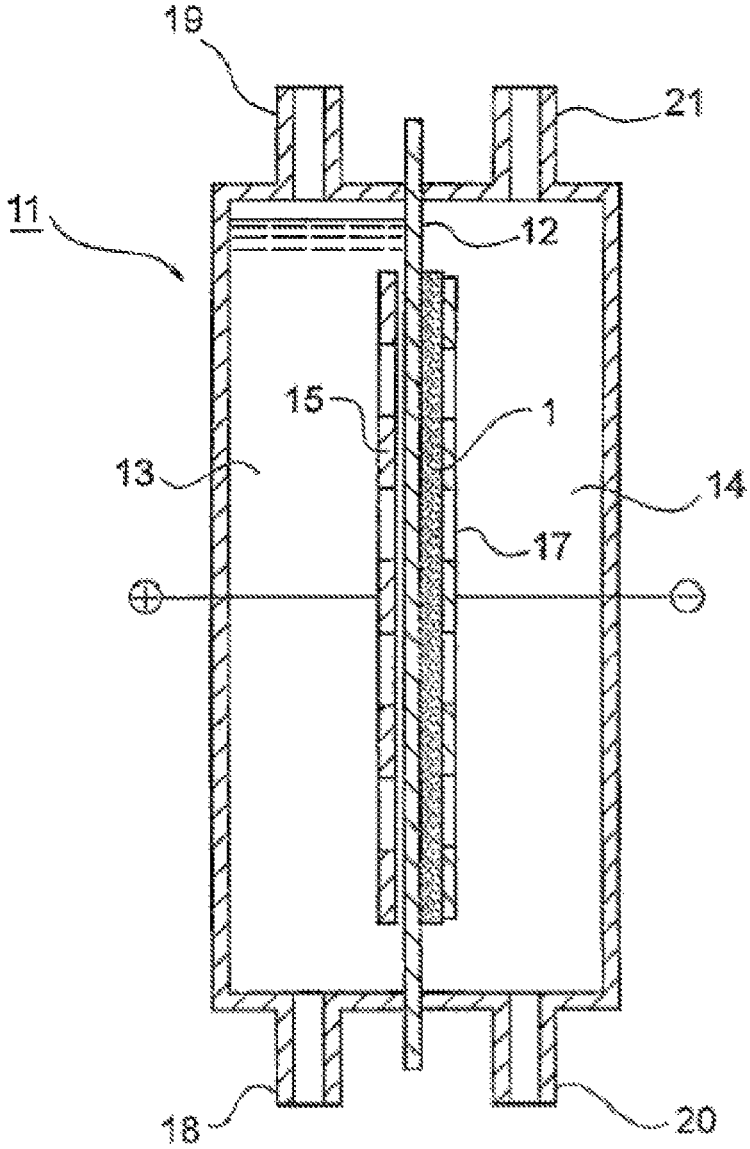
FIG. 2 is a diagrammatic cross-sectional view illustrating a two-chamber type electrolytic cell for sodium chloride electrolysis having a gas diffusion cathode of the invention installed therein.

In a two-chamber type electrolytic cell main body 11 for sodium chloride electrolysis as shown in FIG. 2, an anode chamber 13 and a cathode chamber 14 are partitioned from each other by a cation exchange membrane 12; and in the anode chamber 13, a porous insoluble metal anode 15 made of, for example, an expand mesh is disposed slightly spaced apart from the cation exchange membrane 12. The gas diffusion cathode 1 as shown in FIG. 1 is brought into contact with the cathode chamber side of the cation exchange membrane 12, and a cathode collector 17 is connected to a surface of the gas diffusion cathode 1 opposite to the cation exchange membrane 12. The gas diffusion cathode 1 is prepared by forming silver and palladium as the catalyst layer 2 by coating on the porous conductive substrate 3 such as a carbon cloth obtained by forming a carbon powder together with a fluorocarbon resin as a binder and supporting silver thereon. While illustration is omitted, a hydrophilic sheet may be positioned between the cation exchange membrane 12 and the gas diffusion cathode 1.

18 denotes an anolyte inlet formed on the bottom of the anode chamber 13; 19 denotes an anolyte outlet formed on the top of the anode chamber 13; 20 denotes an oxygen containing gas inlet formed on the bottom of the cathode chamber 14; and 21 denotes a gas outlet formed on the top of the cathode chamber 14.

When current is supplied between the anode 15 and the gas diffusion cathode 1 while supplying a sodium chloride aqueous solution from the anolyte inlet 18 of the thus configured electrolytic cell main body 11 and an oxygen-containing gas from the oxygen-containing gas inlet 20, respectively, a sodium ion is generated in the anode chamber 13 and permeates through the cation exchange membrane 12 to reach the cathode chamber 14. On the other hand, in the cathode chamber 14, a hydroxyl ion is generated in an oxygen reduction manner on the surface of the cathode 1 and is coupled with the foregoing sodium ion to form sodium hydroxide.

Since the foregoing gas diffusion cathode 1 is prepared by forming silver and palladium as the catalyst by coating on the conductive substrate comprising a carbon powder, silver and a fluorocarbon resin, it is able to attain a reduction of overvoltage, a reduction of resisting components and an enhancement of durability and can be used as a cathode for sodium chloride electrolysis which is severe with respect to electrolysis conditions among electrolytic reactions.

Figure 3:
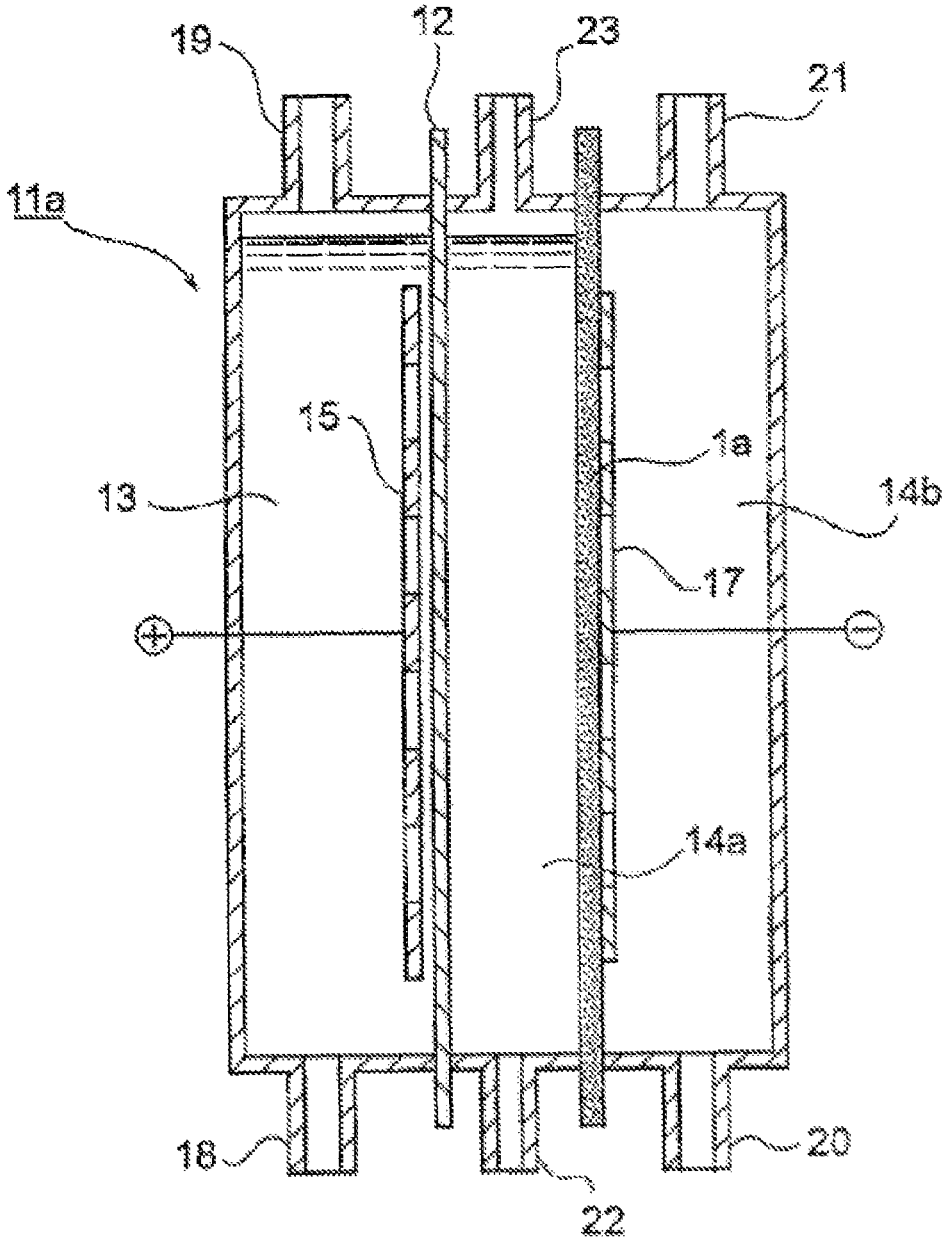
FIG. 3 is a diagrammatic cross-sectional view illustrating a three-chamber type electrolytic cell for sodium chloride electrolysis having a gas diffusion cathode of the invention installed therein.

FIG. 3 is a vertical cross-sectional view showing a three-chamber type electrolytic cell for sodium chloride electrolysis in which the sodium chloride electrolytic cell as shown in FIG. 2 is improved; and the same members as in FIG. 2 are given the same symbols, and explanations thereof are omitted.

In an illustrated three-chamber type electrolytic cell main body 11*a* for sodium chloride electrolysis, different from the sodium chloride electrolytic cell as shown in FIG. 2, a gas diffusion cathode la is spaced apart from a cation exchange membrane 12 and penetrates through the top of a cathode chamber and the bottom of a cathode chamber; a catholyte chamber 14*a* is formed between the gas diffusion cathode la and the cation exchange membrane 12; and a cathode gas chamber 14*b* is formed outward from the gas diffusion cathode la.

22 denotes a dilute sodium hydroxide aqueous solution inlet formed on the bottom of the catholyte chamber 14*a*; and 23 denotes a concentrated sodium hydroxide aqueous solution outlet formed on the top of the catholyte chamber 14*a*.

In the illustrated electrolytic cell main body 11*a*, a concentrated sodium hydroxide aqueous solution can be obtained in the catholyte chamber 14*a* by conducting the electrolysis while supplying a sodium chloride aqueous solution into an anolyte chamber 13, a dilute sodium hydroxide aqueous solution into the catholyte chamber 14*a* and an oxygen-containing gas into the cathode gas chamber 14*b*, respectively.

Figure 4:
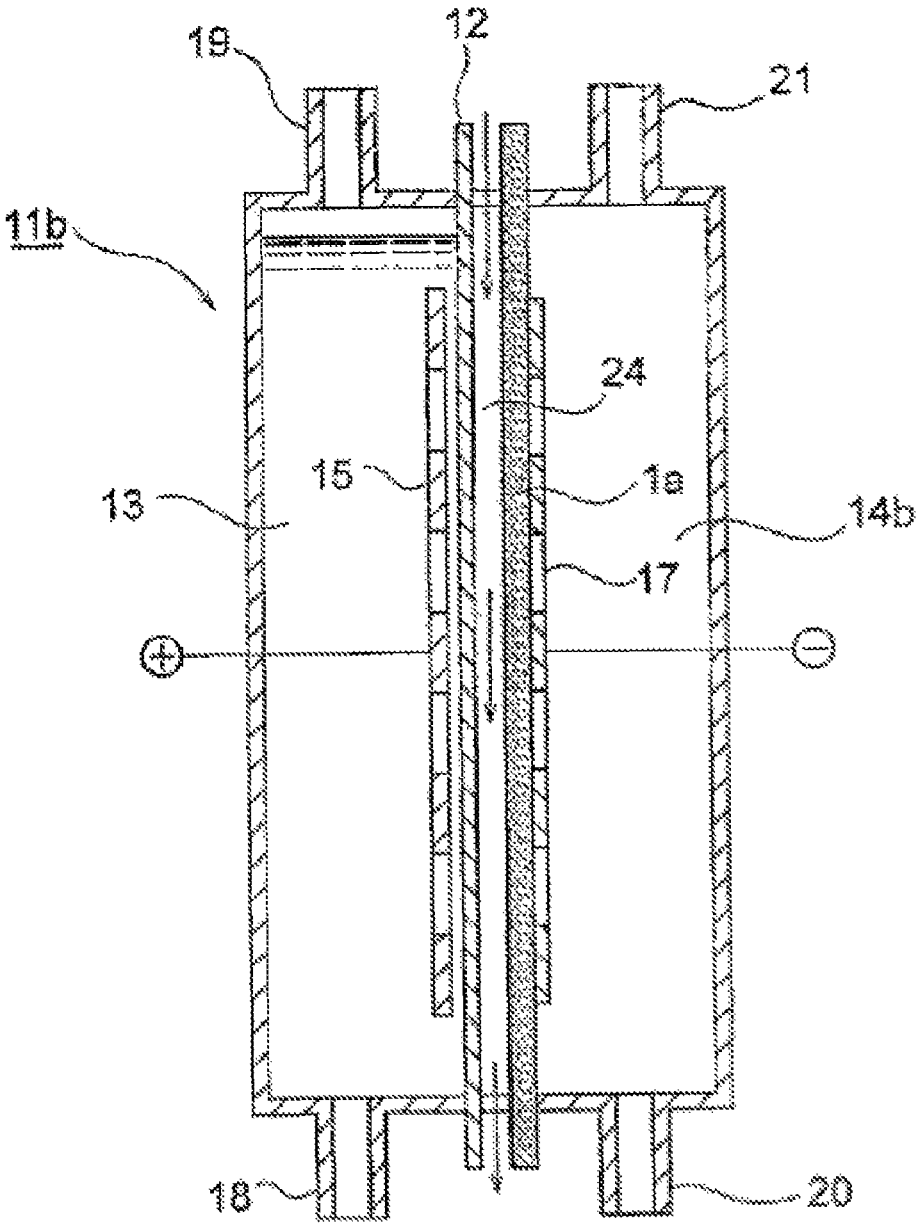
FIG. 4 is a diagrammatic cross-sectional view illustrating a flow-down type electric cell having a gas diffusion cathode of the invention installed therein.

FIG. 4 is a vertical cross-sectional view showing a sodium chloride electrolytic cell in which the sodium chloride electrolytic cell as shown in FIG. 3 is improved; and the same members as in FIG. 3 are given the same symbols, and explanations thereof are omitted.

In an illustrated electrolytic cell main body lib for sodium chloride electrolysis, a gap between a gas diffusion cathode la and a cation exchange membrane 12 is narrower than that in the electrolytic cell as shown in FIG. 3; a flow-down chamber 24 of a dilute sodium hydroxide aqueous solution is formed between the gas diffusion cathode la and the cation exchange membrane 12; and a cathode gas chamber 14*b* is formed outward from the gas diffusion cathode la.

In this electrolytic cell main body 11*b*, when the electrolysis is conducted while supplying a sodium chloride aqueous solution into an anode chamber 13 and an oxygen-containing gas into a cathode gas chamber 14*b*, respectively and allowing a dilute sodium hydroxide aqueous solution to flow down in the flow-down chamber 24, a formed sodium hydroxide aqueous solution is dissolved in the sodium hydroxide aqueous solution as flown down in the flow-down chamber 24 and then taken out.

EXAMPLES

Next, Examples regarding the sodium chloride electrolysis by the oxygen gas diffusion cathode for sodium chloride electrolysis of the invention are illustrated below, but the present invention should not be construed as being limited thereto.

Example 1

A silver particle (AgC—H, manufactured by Fukuda Metal Foil Co., Ltd., particle size: 0.1 μm, specific surface area: 4 $m^2/g$) and a PTFE aqueous suspension (30J, manufactured by Du Pont-Mitsui Fluorochemicals Company, Ltd.) were mixed in a volume ratio of the particle to the resin of 1/1. The mixture was sufficiently stirred in water having TRITON dissolved therein in an amount corresponding to 2% by weight; and the mixed suspension was applied on a 0.4 mm-thick carbon cloth (manufactured by Ballard Material Products Co.) so as to give a silver particle amount per unit projected area of 400 $g/m^2$ to thereby prepare a porous substrate.

A silver/palladium particle (Ag/Pd molar ratio: 2/3, particle size: 0.5 μm, specific surface area: 2 $m^2/g$) and a PTFE aqueous suspension (30J, manufactured by Du PontMitsui Fluorochemicals Company, Ltd.) were mixed in a volume ratio of the particle to the resin of 2/1. The mixture was sufficiently stirred in water having TRITON dissolved therein in an amount corresponding to 2% by weight; and the mixed suspension was applied on one surface of the foregoing substrate so as to give a catalyst particle amount per unit projected area of 200 g/m2 to thereby prepare a porous substrate.

After drying at 60° C., the resulting substrate was baked in an electric furnace at 310° C. for 15 minutes and then subjected to press processing under a pressure of 2 $kgf/cm^2$ to prepare an oxygen gas diffusion cathode.

A DSE containing ruthenium oxide as a major component (manufactured by Permelec Electrode Ltd.) and FLEMION F8020 (manufactured by Asahi Glass Co., Ltd.) were used as an anode and an ion exchange membrane, respectively; a 0.4 mm-thick carbon cloth having been subjected to a hydrophilization treatment was used as a hydrophilic layer; this hydrophilic layer was interposed between the foregoing gas diffusion cathode and the foregoing ion exchange membrane; the foregoing anode and the foregoing gas diffusion cathode were pressed inward; and the respective members were brought into intimate contact with and fixed to each other such that the ion exchange membrane was positioned in a vertical direction, thereby configuring an electrolytic cell.

Figure 5:
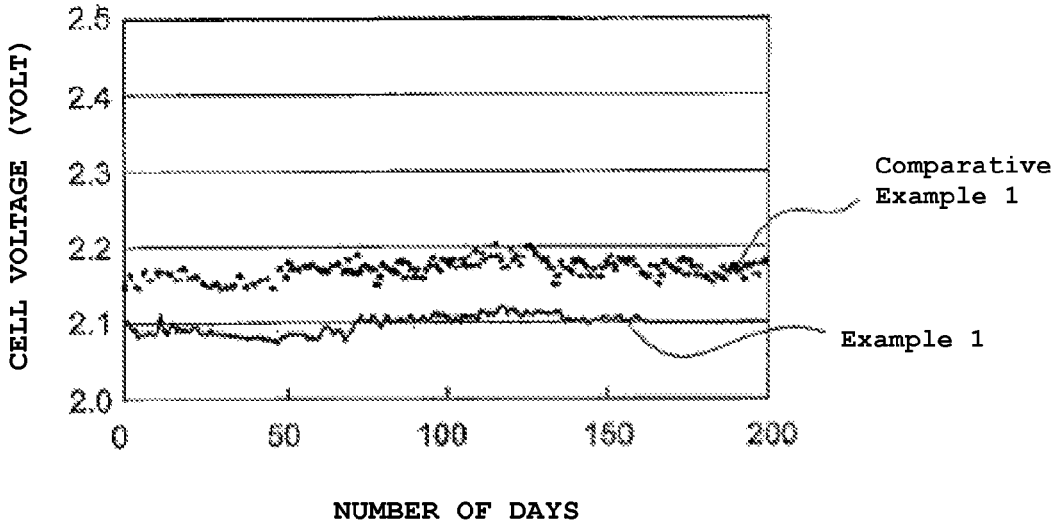
FIG. 5 is graph showing the results of electrolysis in Example 1 and Comparative Example 1.

An anode chamber sodium chloride concentration was adjusted such that a cathode chamber sodium hydroxide concentration was 32% by weight. Also, an oxygen gas was supplied into the cathode in a proportion of about 1.2 times the theoretical amount, and electrolysis was conducted at a liquid temperature of an anolyte of 90° C. at a current density of 60 $A/dm^2$. As a result, an initial cell voltage was 2.10 V. The electrolysis was continued for 150 days. As a result, no increase in cell voltage and overvoltage from the initial values was observed, and a current efficiency was kept at about 95%. The passage of cell voltage in the electrolysis test is shown in FIG. 5.

Example 2

An electrolytic cell was fabricated and worked in the same manner as in Example 1, except that the silver/palladium particle and the PTFE aqueous suspension were mixed in a volume ratio of the particle to the resin of 1/1. As a result, the cell voltage was 2.11 V in the initial stage and after the electrolysis for 150 days, respectively.

Example 3

An electrolytic cell was fabricated and worked in the same manner as in Example 1, except that the composition of the silver/palladium particle was changed to have a Ag/Pd molar ratio of 1/1. As a result, the cell voltage was 2.11 V in the initial stage and after the electrolysis for 30 days, respectively.

Example 4

An electrolytic cell was fabricated and worked in the same manner as in Example 1, except that the composition of the silver/palladium particle was changed to have a Ag/Pd molar ratio of 2/1. As a result, the cell voltage was 2.13 V in the initial stage and after the electrolysis for 30 days, respectively.

Example 5

An electrolytic cell was fabricated and worked in the same manner as in Example 1, except that the catalyst amount of the silver/palladium particle was changed to 50 g/m$^2$. As a result, the cell voltage was 2.13 V in the initial stage and after the electrolysis for 30 days, respectively.

Example 6

An electrolytic cell was fabricated and worked in the same manner as in Example 1, except that the catalyst amount of the silver/palladium particle was changed to 10 g/m$^2$. As a result, the cell voltage was 2.14 V in the initial stage and after the electrolysis for 30 days, respectively.

Example 7

A carbon cloth substrate having a silver particle amount of 500 g/m$^2$ was prepared in the same manner as in Example 1. An electrolytic cell was fabricated and worked in the same manner as in Example 1, except for using a silver/palladium catalyst prepared by: applying a liquid obtained by dissolving silver nitrate and dinitrodiamine palladium in a molar proportion of Ag/Pd of 1/1 in allyl alcohol on the foregoing substrate so as to give a catalyst amount of 60 g/m$^2$; and heat decomposing the resulting substrate at 300° C. As a result, the cell voltage was 2.12 V in the initial stage and after the electrolysis for 30 days, respectively.

Example 8

A silver particle (0.1 pm) and a palladium particle (0.1 pm) were added in a molar ratio of Ag/Pd of 1/2 to a PTFE aqueous suspension and mixed in a volume ratio of the particle to the resin of 1/1. The mixture was sufficiently stirred in water having TRITON dissolved therein in an amount corresponding to 2% by weight; and the mixed suspension was applied on one surface of the silver/carbon cloth substrate of Example 1 so as to give a catalyst amount of 150 g/m$^2$. An electrolytic cell was fabricated and worked in the same manner as in Example 1. As a result, the cell voltage was 2.06 V in the initial stage and 2.07 V after the electrolysis for 90 days, respectively.

Example 9

A carbon particle (particle size: not more than 0.1 pm) and a PTFE aqueous suspension were mixed in a volume ratio of the particle to the resin of 1/1; and suspension was press formed so as to give a particle amount per projected area of 500 g/m$^2$ while using a 0.5 mm-thick silver mesh as a core material, thereby preparing a porous substrate.

The silver/palladium catalyst of Example 1 was formed on the foregoing substrate, and an electrolytic cell was fabricated and worked in the same manner as in Example 1. As a result, the cell voltage was 2.14 V in the initial stage and after the electrolysis for 30 days, respectively.

Comparative Example 1

The same electrolysis test as in Example 1 was conducted, except for using a catalyst particle prepared by mixing a silver particle (AgC—H) and a PTFE aqueous suspension in a volume ratio of the particle to the resin of 1/1. As a result, the cell voltage increased from 2.16 V in the initial stage to 2.20 V after the electrolysis for 150 days. The electrode after the electrolysis was subjected to SEM observation. As a result, agglomeration of the silver catalyst particle (0.1 μm in the initial stage-*1 μm after the electrolysis) was confirmed. The passage of cell voltage in the electrolysis test is shown in FIG. 5.

Comparative Example 2

The same electrolysis test as in Example 1 was conducted, except for using a catalyst particle prepared by mixing a silver particle (particle size: 0.02 μm) and a PTFE aqueous suspension in a volume ratio of the particle to the resin of 1/1. As a result, the cell voltage increased from 2.12 V in the initial stage to 2.20 V after the electrolysis for 30 days. The electrode after the electrolysis was subjected to SEM observation. As a result, agglomeration of the silver catalyst particle (1 μm after the electrolysis) was confirmed.

Comparative Example 3

The same electrolysis test as in Example 1 was conducted, except for using a catalyst particle prepared by mixing a palladium particle (particle size: 0.1 μm) and a PTFE aqueous suspension in a volume ratio of the particle to the resin of 1/1. As a result, the cell voltage was 2.2 V from the initial stage.

Example 10

The electrolysis of Example 1 was continuously worked for 10 days (cell voltage: 2.10 V); the current was then turned off; and the electrode was subjected to short circuit without performing substitution with nitrogen and exchange of the sodium chloride aqueous solution and allowed to stand a whole day and night. Thereafter, the temperature which had dropped to room temperature was increased; the current was then turned on to work the cell; and one day thereafter, the cell voltage was measured and found to be 2.11 V.

Comparative Example 4

The cell of Comparative Example 1 was subjected to the short circuit test as in Example 10. As a result, the voltage before the short circuit was 2.17 V, whereas the voltage after resuming the short circuit increased to 2.23 V.

Example 11

An electrolytic cell was fabricated and worked in the same manner as in Example 1, except that a silver/palladium alloy particle prepared by thermal plasma (Ag/Pd molar ratio: 2/3, particle size: 0.02 μm, specific surface area: 100 $m^2/g$) and a PTFE aqueous suspension were mixed in a volume ratio of the particle to the resin of 1/1. As a result, the cell voltage was 2.05 V in the initial stage and after the electrolysis for 150 days, respectively.

Example 12

A silver particle (AgC—H) was mixed with 10 g/L of a palladium chloride aqueous solution, and sodium borohydride was added as a reducing agent, thereby forming metallic palladium on the silver particle. A molar ratio of Ag to Pd was 8/1. The mixed particle and the a PTFE aqueous suspension were mixed in a volume ratio of 1/1, and a mixed suspension having TRITON dissolved therein in an amount corresponding to 2% by weight was prepared. On one surface of the silver/carbon cloth substrate of Example 1, the mixed suspension was applied on a 0.4 mm-thick carbon cloth (manufactured by Ballard Material Products Co.) in a silver particle amount per unit projected area of 200 $g/m^2$ to prepare a porous substrate.

An electrolytic cell was fabricated and worked in the same manner as in Example 1. As a result, the cell voltage was 2.06 V in the initial stage and after the electrolysis for 30 days, respectively.

Example 13

A three-chamber cell as shown in FIG. 3 was configured by using the electrode of Example 9 and the same anode and membrane as in Example 1 and setting up a distance between the membrane and the electrode at 2 mm. An anode chamber sodium chloride concentration was adjusted such that a cathode chamber sodium hydroxide concentration was 32% by weight. Also, an oxygen gas was supplied into the cathode in a proportion of about 1.2 times the theoretical amount, and electrolysis was conducted at a liquid temperature of an anolyte of 90° C. at a current density of 30 $A/dm^2$. As a result, an initial cell voltage was 1.96 V. A current efficiency was kept at about 97%.

Comparative Example 5

The same three-chamber cell as in Example 13 was worked by using a catalyst prepared by forming the catalyst of Comparative Example 1 on the porous substrate of Example 9. As a result, the cell voltage in the initial stage was 2.05 V.

While the present invention has been described in detail and with reference to specific embodiments thereof, it will be apparent to one skilled in the art that various changes and modifications can be made therein without departing from the spirit and scope thereof.

This application is based on Japanese Patent Application No. 2006-314216 filed Nov. 21, 2006, and the contents thereof are herein incorporated by reference.

What is claimed is:

1. An oxygen gas diffusion cathode for sodium chloride electrolysis comprising:

a porous conductive substrate comprising silver, a hydrophobic material and a carbon material; and a catalyst comprising silver and palladium, coated on the porous conductive substrate, wherein the catalyst has a molar ratio of silver to palladium of from 10/1 to 1/4.

2. The oxygen gas diffusion cathode according to claim 1, wherein the carbon material is a carbon cloth or a carbon fiber sintered body.

3. The oxygen gas diffusion cathode according to claim 1, wherein the catalyst has a molar ratio of silver to palladium of from 8/1 to 2/3.

* * * * *